United States Patent [19]

Wilson

[11] Patent Number: 4,583,877

[45] Date of Patent: Apr. 22, 1986

[54] RING BINDER COVER

[75] Inventor: Robert B. Wilson, Holyoke, Mass.

[73] Assignee: Dennison National Company, Holyoke, Mass.

[21] Appl. No.: 672,703

[22] Filed: Nov. 19, 1984

[51] Int. Cl.[4] ..... B42F 3/00; B42D 3/00

[52] U.S. Cl. ..... 402/75; 281/29

[58] Field of Search ..... 402/73, 74, 75, 76, 402/77, 78, 502, 80 R; 412/3; 281/29, 36, 37

[56] References Cited

U.S. PATENT DOCUMENTS

| | | | |
|---|---|---|---|
| 1,787,958 | 1/1931 | Schade | 402/80 R |
| 1,923,646 | 8/1933 | Trussell | 402/77 |
| 2,024,881 | 12/1935 | Schade | 402/75 |
| 2,772,427 | 12/1956 | Rankin | 402/75 |
| 3,206,225 | 9/1965 | Oleson | 281/29 |
| 3,262,454 | 7/1966 | Shillinger | 402/75 |
| 4,400,107 | 8/1983 | Pitts | 402/80 R |

*Primary Examiner*—Paul A. Bell

*Assistant Examiner*—Paul M. Heyrana, Sr.

*Attorney, Agent, or Firm*—Chapin, Neal & Dempsey

[57] ABSTRACT

A ring binder cover is composed of a pair of thermoplastic sheets superimposed in edge-to-edge relation with stiffener insert panels disposed therebetween. The inner edges of the insert panels are spaced apart a distance which is approximately the width of the back panel and hinged portions of the binder. The peripheral edge portions of the two thermoplastic sheets are sealed together and provide a sealed envelope for the stiffener inserts which are disposed therebetween and define semi-rigid back and front cover panels of the binder. A discrete, semi-rigid spine is affixed to the outer surface of the cover in the area between the inner edges of the inserts. The spine has a width less than the distance between the inserts and together define hinges for the binder covers. The spine is composed of a stiffening insert panel encased within a thermoplastic sheath material and a ring mechanism is affixed on the inner surface of the cover opposite the spine.

6 Claims, 3 Drawing Figures

RING BINDER COVER

BACKGROUND OF THE INVENTION

For many years it has been the practice in the manufacture of ring binders to fabricate the cover for such binders in a three-ply construction. Three rigid or semi-rigid, rectangular inserts or stiffener panels are heat-sealed between two superimposed sheets of thermoplastic material. Of the three stiffener panels generally used, two of them approximate in size, the back and front cover panels of the binder and the third panel is a narrower insert strip disposed between the two larger panels to form the back panel of the binder. The inner and outer plastic sheets are fused together or heat-sealed around their peripheral edges and also transversely between the adjacent, transverse edges of the cover panel inserts and the back panel inserts. The transverse seals form the hinge areas of the binder and U.S. Pat. No. 3,195,924 is typical of this type of binder construction.

There are several significant disadvantages of a conventional heat-sealed binder cover, particularly along the hinge portions where the cover and the spine or backbone of the binder intersect. Along the hinge lines, the outer plastic sheets are fused or heat-sealed together and their composite thickness is substantially less than the total thickness of the two sheets before the heat-sealing operation. For example: where the two outer sheets of thermoplastic are each 0.015 inch vinyl, the composite thickness, when fused together, is only about 0.020 inch or about 30% less than the total of 0.030 inch where there has been no heat-sealing of the plastic sheets.

In addition, during heat-sealing, the more volatile plasticizers in the vinyl sheet materials are volatilized "off" and the hinge lines tend to be more brittle than the unfused vinyl. Moreover, during the heat-sealing operation, the vinyl films along the hinge lines are invariably stretched over the edges of the chipboard inserts when drawn together for sealing so that the plastic sheet material in these areas becomes thinner than the unsealed vinyl and thus more susceptible to material fatigue failure.

The principal object of this invention is to provide an improved ring binder construction and method of fabricating the same which overcome the drawbacks of the prior art construction.

Another object of this invention is to provide an improved ring binder cover having a backbone and hinge construction of remarkably enhanced durability without sacrifice in either the appearance or functionality of the binder.

The above and other objects and advantages of this invention will be more readily apparent from a reading of the following description taken in conjunction with the following drawings in which.

Figure 1:
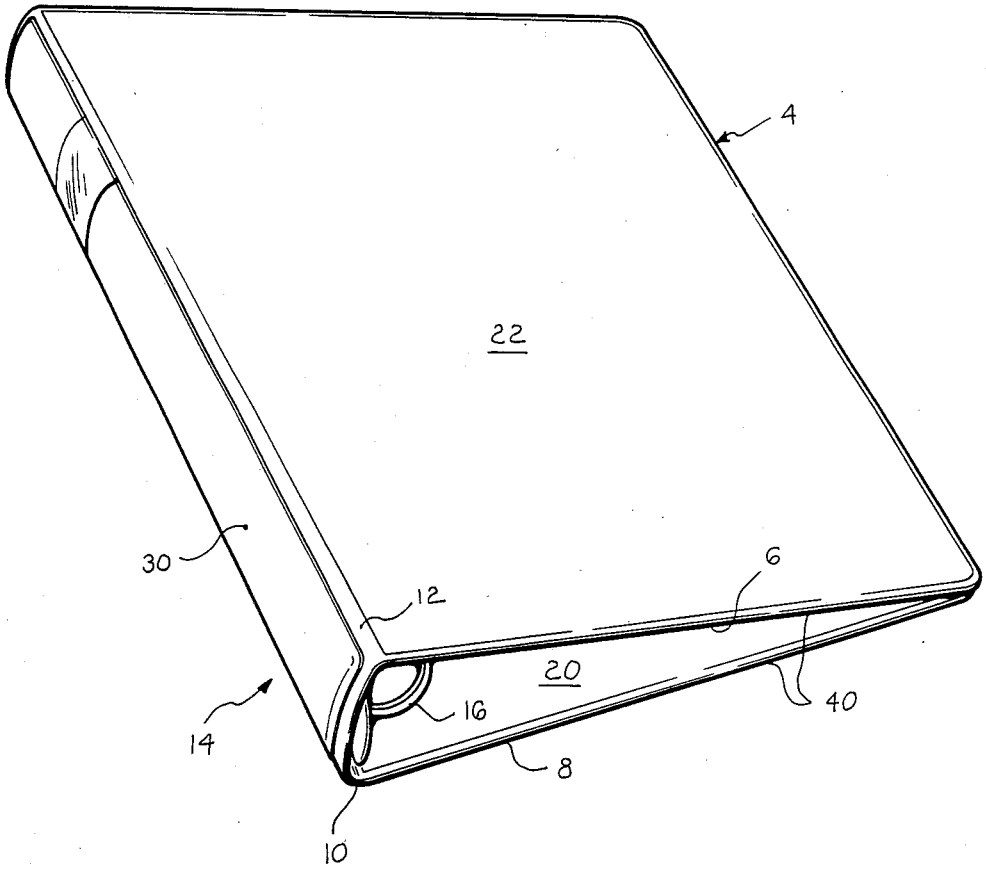
FIG. 1 is a perspective view of a ring binder of the type embodying this invention.

Referring in detail to the drawings, in FIG. 1 is shown a ring binder 4 of the type embodying this invention. The ring binder includes front and back cover panels 6 and 8, respectively. The two cover panels are hinged along transverse hinge lines 10 and 12 to a back panel or the spine portion of the binder, as indicated generally at 14. A conventional ring binder mechanism 16 is affixed to the inner surface of the binder along its backbone portion.

The binder is composed of two rectangular sheets or films 20 and 22 of a synthetic plastic material which is preferably a thermoplastic heat-sealable or fusible material, such as an ethylvinylacetate polymer. The vinyl polymer sheets 20 and 22 are of sufficient overall size to form the entire inner and outer surface covering of the binder. These sheets may be of any desirable surface texture and may be of any suitable color to give the binder its desired appearance.

Disposed between thermoplastic sheets, are a pair of semi-rigid or form stable, rectangular inserts 24 and 26 which are dimensioned to be approximately the same length and width as the cover panels of the binder. The inserts may be made of any suitable stiffening material, such as chipboard or fiberboard. An external spine member 30 is fitted against the outer surface of the vinyl sheet 22 along the back panel portion of the binder, that is the portion between the opposed inner edges of the two chipboards 24 and 26.

Figure 2:
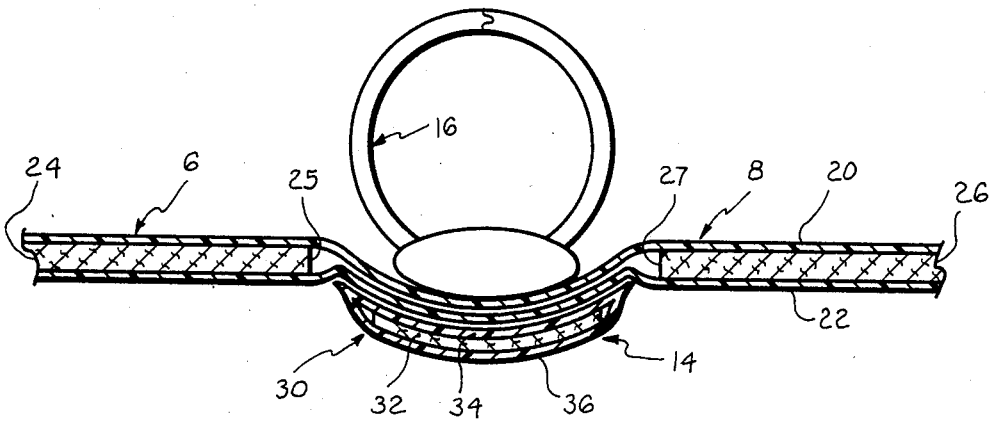
FIG. 2 is an elevational view on an enlarged scale showing a portion of the binder of FIG. 1.
Figure 3:
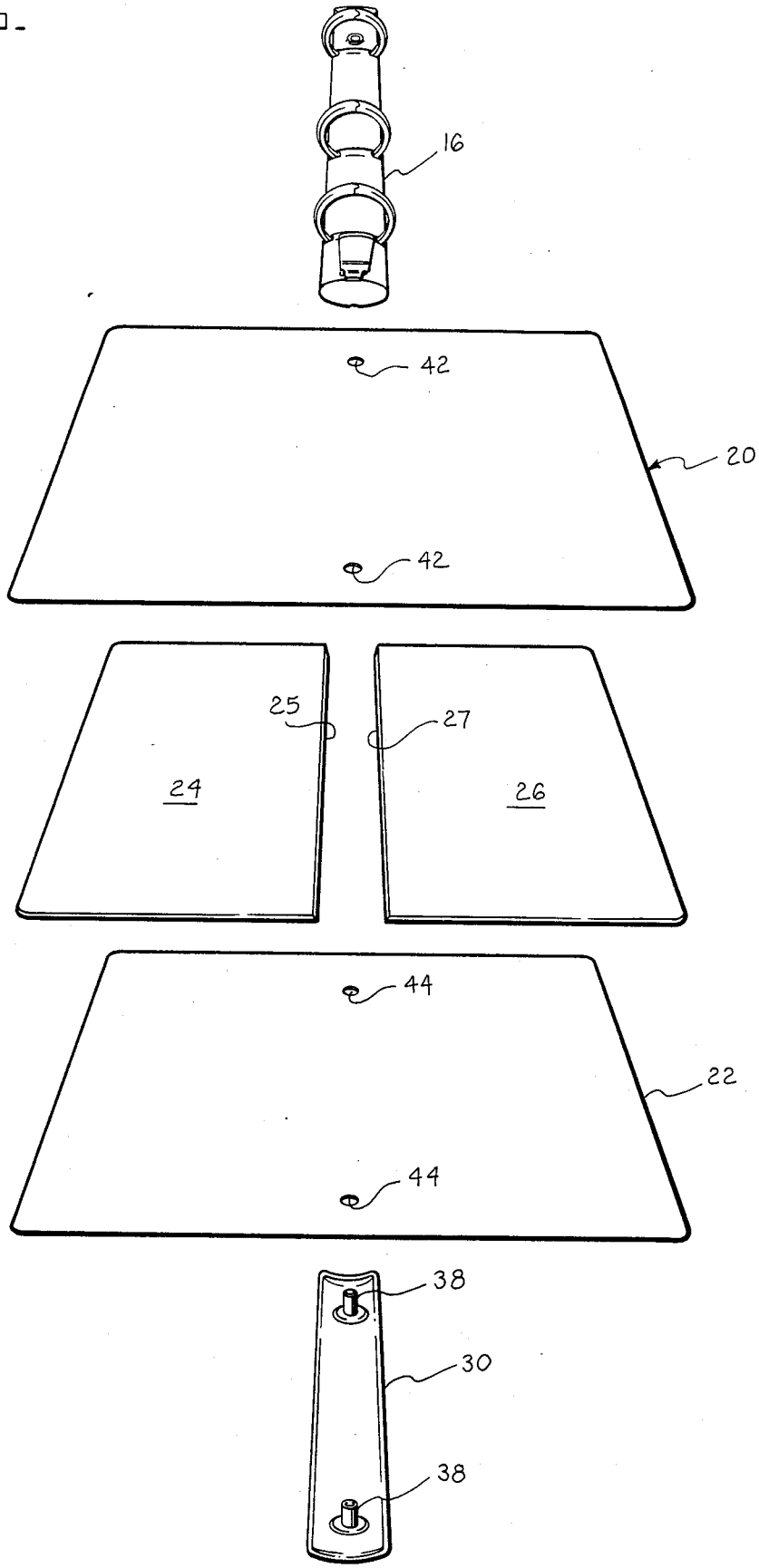
FIG. 3 is an exploded perspective view showing the components of which the ring binder embodying this invention is composed.

In fabricating the binder, the cover inserts 24 and 26 are disposed between two sheets of the vinyl polymer sheet material and only the peripheral edges 40 (FIG. 1) of the vinyl sheets are sealed together. In this manner, a large sealed pocket or envelope is formed which encapsulates the two inserts. It will be noted that no transverse sealing of the vinyl is carried out in the area of the binder backbone between the spaced inner side edges 25 and 27 of the cover inserts. Thus, as best illustrated in FIG. 2, the thermoplastic sheets or films remain entirely separated and unfused in the hinge areas of the binder cover. To form the hinges of the binder and to strengthen and stabilize the backbone portion of the binder, the external spine 30 is then disposed between the spaced inner edges of the inserts 24 and 26.

The spine is composed of a form stable or stiffening insert 32 which may be formed of metal, chipboard or plastic or any other rigid or semi-rigid composition. As shown in FIG. 2, the insert may be thinner in cross-section than the cover panel inserts to present a neat and clean appearance, as best illustrated in FIG. 1. Preferably, the spine is composed of an insert 32 which has a curved or cylindrical cross-section, although a flat insert might also be used if an angular look is desired. The insert is preferably preshaped or premolded in its curved configuration and is disposed between a pair of thermoplastic sheets or films 34 and 36 which are heat-sealed around the periphery to encase the insert so that it presents the same general appearance as the binder covers. The spine 30 also includes a pair of upstanding posts, studs or rivets 38 which are longitudinally spaced apart to fit through correspondingly spaced holes 42 and 44 provided through the vinyl sheets along the centerline thereof. By peening over their inner ends, the rivets serve to fasten the base plate of the binder mechanism 16 securely against the inner surface of the sheet 20 and to draw the spine firmly against the outer surface of the binder. By this construction, the two separate plies 20 and 24 in the backbone area of the binder are clamped together.

The hinges of the binder 10 and 12 are formed by the two superimposed plastic sheets 20 and 22 along their transverse portions located between the outer side edges of the spine insert 32 and the inner side edges of cover inserts 24 and 26. With this construction, since there is no thermal sealing or fusion of the thermoplastic sheath material in the hinge areas. The sheets will thus retain their inherent tear strength and pliability and remain highly resistant to embrittlement and material fatique in contrast to such tendencies in similar types of binders heretofore available.

This construction thus has all the advantages of the conventional three-ply binder construction of stiffening inserts sealed between thermoplastic sheets, but does not suffer the drawbacks of these prior binder constructions because the hinges are formed by two entirely discrete plies. Furthermore, while the spine or back panel and the binder is still composed of a multiply construction having a stiffening core encased between synthetic plastic layers, it is entirely external to the cover construction per se and does not cause a weakening along the hinge lines of the binder.

Having thus disclosed this invention, what is claimed is:

1. Ring binder construction comprising matching plies of thermoplastic outer cover sheet material superimposed in edge-to-edge relation and sealed together about their peripheral edges, inserts encased between said plies of cover sheet material and having side edges spaced apart a predetermined distance along the center portion of the cover sheet material, said stiffener inserts being dimensioned to define the binder's front and back cover panels, said binder having a back panel portion which includes opposed portions of the outer cover sheet material between the spaced edge portions of said inserts, a ring mechanism disposed within said binder along the back panel thereof, and a stiffening spine having a width less than said predetermined distance, said binder having flexible hinges formed by coextensive, unsealed portions of said plies of cover sheet material disposed between the outer side edges of said spine and the inner side edges of said inserts.

2. Ring binder as set forth in claim 1, in which the transverse cross-section of said spine is convexly curved outwardly and each of said flexible hinges consists essentially of the coextensive, unsealed portions of said plies of cover sheet maaterial.

3. Ring binder as set forth in claim 2, in which said spine is disposed externally of both said plies of cover sheet material and includes a stiffener insert which is encased within a thermoplastic sheath.

4. Ring binder as set forth in claim 3, in which fastener means extend through the cover sheet s in the back panel portion of the binder from the spine to said ring mechanism to fasten both the spine and binder mechanism in place and clamp the cover sheets therebetween.

5. Ring binder as set forth in claim 4, in which stiffener insert of said spine has a thickness substantially less than the thickness of the cover panel inserts.

6. Ring binder as set forth in claim 5, in which the fastener means is in the form of upstanding rivets having their flanged ends affixed to said spine and having their inner ends riveted to the ring mechanism.

* * * * *